United States Patent [19]

Kageyama et al.

[11] Patent Number: 4,714,365

[45] Date of Patent: Dec. 22, 1987

[54] MECHANICAL PENCIL

[75] Inventors: Hidehei Kageyama; Yukimasa Kuwabara, both of Saitama, Japan

[73] Assignee: Kabushikikaisha Kotobuki, Kyoto, Japan

[21] Appl. No.: 849,506

[22] PCT Filed: Jan. 25, 1986

[86] PCT No.: PCT/JP86/00032

§ 371 Date: Mar. 14, 1986

§ 102(e) Date: Mar. 14, 1986

[87] PCT Pub. No.: WO86/04300

PCT Pub. Date: Jul. 31, 1986

[30] Foreign Application Priority Data

| | | | |
|---|---|---|---|
| Jan. 26, 1985 | [JP] | Japan | 60-9595 |
| Jan. 26, 1985 | [JP] | Japan | 60-9596 |
| Oct. 22, 1985 | [JP] | Japan | 60-161400 |
| Dec. 28, 1985 | [JP] | Japan | 60-203143 |

[51] Int. Cl.[4] ..... B43K 21/16

[52] U.S. Cl. ..... 401/65; 401/67; 401/94

[58] Field of Search ..... 401/65, 67, 94

[56] References Cited

U.S. PATENT DOCUMENTS

| | | | |
|---|---|---|---|
| 3,864,046 | 2/1975 | Butka | 401/65 |
| 4,358,210 | 11/1982 | Hashimoto et al. | 401/65 |
| 4,360,280 | 11/1982 | Sekiguchi et al. | 401/194 |
| 4,362,410 | 12/1982 | Hashimoto | 401/67 |
| 4,371,277 | 2/1983 | Kageyama et al. | 401/65 |
| 4,382,706 | 5/1983 | Hashimoto et al. | 401/65 |

*Primary Examiner*—Richard J. Scanlan, Jr.
*Assistant Examiner*—Anthony Knight
*Attorney, Agent, or Firm*—Bernard, Rothwell & Brown

[57] ABSTRACT

A mechanical pencil wherein a slider 11 in contact with a lead and an outer tube 1 with different frictional resistances other than a lead delivery mechanism for effecting lead-feed by general knocking operation are provided within the outer tube 1 or a fore means 2, whereby the end of a consumed lead 19 is pressed against or released from a surface of paper or the like to thereby project the lead 19 from a lead guide 12 by an amount corresponding to backward movement of the slider 11. The lead-feeding may be easily accomplished merely by pressing operation without changing the grip of the outer tube 1.

4 Claims, 13 Drawing Figures

MECHANICAL PENCIL

TECHNICAL FIELD

This invention relates to a knocking type mechanical pencil, and particularly to a mechanical pencil which can accomplish lead-feeding operation by way of knocking and in addition, can project a lead from a lead guide merely by pushing the lead against the surface of paper or the like, thus rendering writing possible to perform.

BACKGROUND

In case of performing writing by a mechanical pencil, the length of a lead projected from the end of a lead guide is limited to a substantially predetermined amount beyond which the lead is liable to be broken, and when the length of such projection is reduced due to the wear or the like during writing, it is necessary that for example, a button or the like provided at the rear end of a lead pipe is knocked to thereby deliver the lead of the desired length.

However, since this lead-feeding operation is not carried out unless the writing operation is discontinued, there gives rise to a problem in that the writing efficiency is deteriorated.

DISCLOSURE OF THE INVENTION

An object of the present invention is to provide a solution of these problems noted above with respect to prior art. An object of the invention is to provide a mechanical pencil wherein a slider engaging a lead and an outer tube with different frictional resistances is provided for effecting lead-feed by a delivery mechanism other than a general knocking operation, whereby the end of a consumed lead is pressed against or released from a surface of paper or the like to thereby project the lead from a lead guide by an amount corresponding to backward movement of the slider. The lead-feeding may be easily performed merely by pressing operation without changing the grip of the outer tube.

BRIEF DESCRIPTION OF THE DRAWINGS

FIG. 10(*b*) is a perspective view of another stopper portion;

BEST MODE FOR CARRYING OUT THE INVENTION

Embodiments of the present invention will now be described with reference to the drawings.

Figure 1:
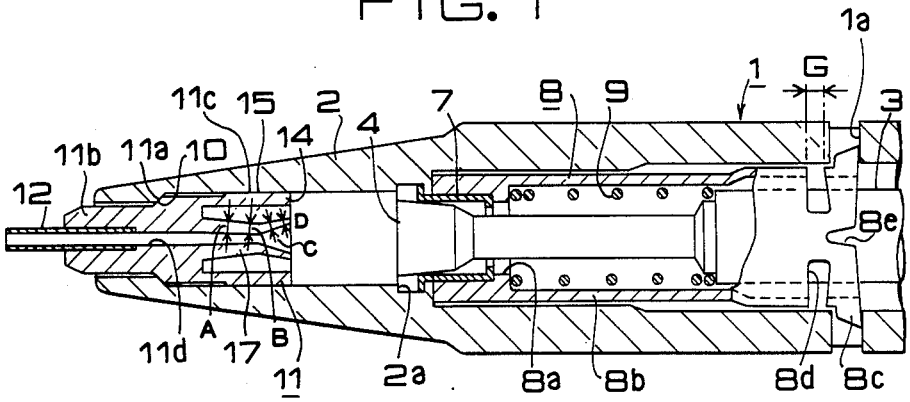
FIG. 1 is a sectional view of essential parts showing one embodiment of a mechanical pencil having a slider member in accordance with the present invention.
Figure 2:
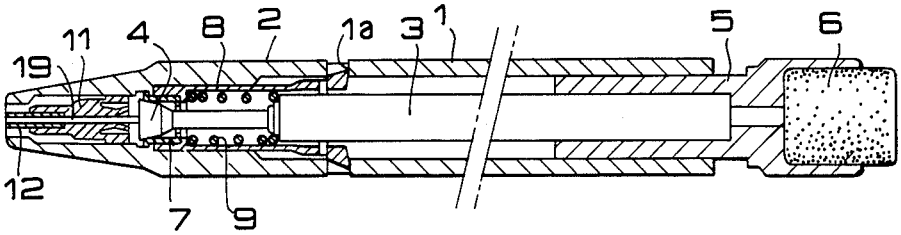
FIG. 2 is a sectional view of the whole structure of the pencil.
Figure 3:
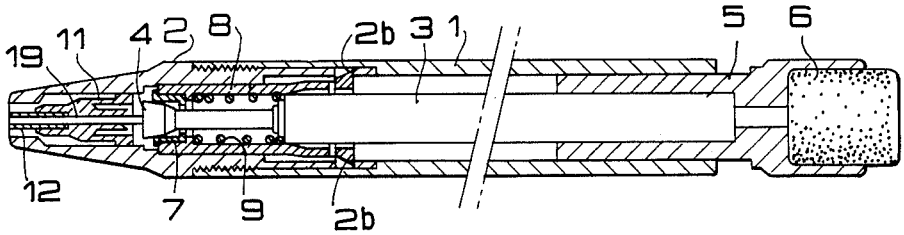
FIG. 3 is a sectional view of the whole structure of the pencil according to a further embodiment.
Figure 4:
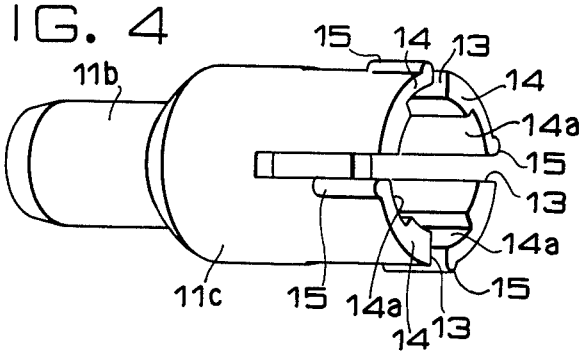
FIG. 4 is a perspective view of a slider member.
Figure 5:
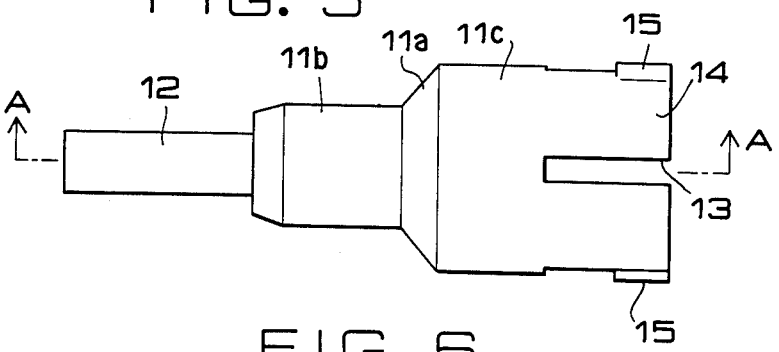
FIG. 5 is a side view of a slider member.
Figure 6:
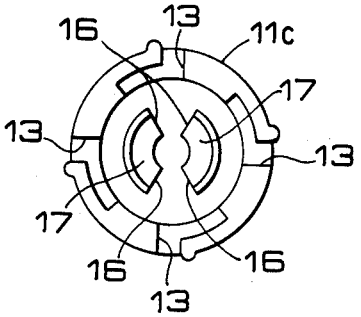
FIG. 6 is a front view of a slider member.
Figure 7:
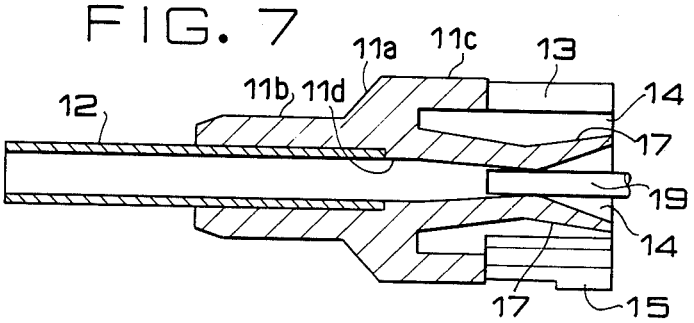
FIG. 7 is a sectional view taken on line A—A of FIG. 5.

In FIGS. 1 and 2, reference numeral 1 designates an outer tube which can be gripped by a hand, the outer tube 1 having a fore means 2 provided integrally therewith. It is to be noted that the fore means 2 can be one separated from the outer tube 1 as shown in FIG. 3.

A lead pipe 3 is coaxially inserted into the outer tube 1, and a lead chuck 4 is connected to the end of the lead pipe 3. A receiving member 5 is detachably fitted in the rear end of the lead pipe 3 to accommodate an India rubber 6 therein. The end of the lead chuck 4 extends through the center of a chuck fastening ring 7, and the rear end of the chuck fastening ring 7 is opposed to a flange 8*a* at the front portion of a cushion sleeve 8 which is axially movable within the outer tube 1. The cushion sleeve 8 is formed of a resilient member such as deformable polyacetal or other resiliently deformable resilient members, the cushion sleeve 8 being formed into a cylindrical configuration as a whole, and the cushion sleeve 8 is provided at the rear end with a stopper portion 8*c* which projects outwardly from the outside diameter of a body 8*b*. The body 8*b* is provided with a cut 8*d* and provided at the rear end with an axially extending cut 8*e* so that the stopper portion 8*c* may generate a suitable flexible springing force with respect to the body 8*b*. The stopper portion 8*c* is formed into an anti-slip shape so that the sleeve 8 may engage an engaging hole 1*a* made in the outer tube 1 positively, smoothly and without play by one-touch pushing-in operation when the sleeve 8 is incorporated into the outer tube together with a lead delivery mechanism. Thus, the body 8*b* is resiliently displaced with a limit of an axial gap G portion of the cut 8*d* with respect to the stopper portion 8*c* supported in the engaging hole 1*a* and the body 8*b* is normally urged forwardly. A chuck fastening resilient member 9 for rearwardly urging the lead pipe 3 is interposed between the front end of the lead pipe 3 and the flange 8*a* of the cushion sleeve 8.

The fore means 2 is conically narrowed at the end thereof, and is formed at the inner peripheral diameter of the end with an engaging surface 10 in the form of an inclined stepped portion for varying the inner peripheral diameter. Encased in the inner peripheral portion of the aforesaid end is a slider member 11 having a stopper surface 11*a* which is axially slidable but controlled in forward displacement by the engaging surface 10.

The slider member 11 is integrally molded of a synthetic resin such as ABS resin or polyacetal into a tubular configuration as a whole.

This slider member 11 is integrally comprised of two tubular members which are different in diameter as a whole as shown in FIGS. 4, 5, 6 and 7. More specifically, reference numeral 11*b* designates a small diameter portion, and reference number 11*c* designates a large diameter portion. A lead guide 12 is fitted under pressure or the like into a center hole of the small diameter portion 11*b* to allow a lead to pass therethrough as will be described hereinafter. Also, a through-hole 11*d* for allowing a lead to pass therethrough is provided in a thick-wall portion in the vicinity of a central portion connecting the small diameter portion 11*b* with the large diameter portion 11*c*. The large diameter portion 11*c* is in the form of a double tube, an outer tube portion of which is axially formed with cuts 13 at equidistant intervals to thereby form four sliding members 14 having a springing force. The cuts 13 of these sliding members 14 each have in their neighbourhood an integral projection 15. The portion near the side of each sliding member 14 where the projection 15 is provided has a thinwall portion 14*a* so as to apply a resiliency to the sliding member 14 more effectively. The other inner tubular portion is provided with a cut 16 to thereby form a pair of sliding contact members 17 having a smaller springing force to lightly hold a lead internally of the sliding members 17. While in the illustrated embodiment, two sliding contact member 17 are provided, it is to be understood that more than two members can be provided.

Each sliding contact member 17 is formed to be reduced in thickness gradually toward the rear end thereof Therefore, the relation of $A \geqq B \geqq C \geqq D$ is established to render extrusion molding possible.

Reference numeral 19 designates a lead. Resilient contact of the lead 19 by the sliding contact members 17 is effected by a predetermined frictional force $P_1$, and the projections 15 come into resilient contact with the inner peripheral wall of the fore means 2 by a predetermined frictional force $P_2$, which is set to be sufficiently great relative to the frictional force $P_1$.

Next, the operation of the mechanical pencil will be described.

In the state where the forward external force is not exerted on the rear portion of the lead pipe 3, the cushion sleeve 8 is held at the front end of a movable region thereof, whereas the lead chuck 4 urged in the direction of backward movement is moved back relative to the chuck ring 7 and therefore the end of the lead chuck 4 grips the lead 19. In the FIG. 1 state, when the lead pipe 3 is knocked from the side of the India rubber 6, the lead chuck 4 is likewise moved forward together with the chuck ring 7, and when the ring 7 comes into engagement with a shoulder 2*a* of the fore means 2, only the lead chuck 4 advances leaving the ring 7 to release the gripping of the lead 19. When the aforesaid knocking operation is released, the lead pipe 3 is moved backward together with the lead chuck 4, and the chuck fastening ring 7 abuts with the front edge of the cushion sleeve 8, at which position the end of the lead chuck 4 is fastened to hold the lead 19 and stop the backward movement of the lead pipe 3. This operation is repeated whereby the lead 19 is successively delivered. The length of the lead 19 delivered by one lead-feed operation is approximately equal to the distance from the front end of the ring 7 to the shoulder 2*a*.

In the process for advancing the lead 19 by the lead-feed operation as described above, the frictional resistance between the lead 19 and the sliding contact member 17 is smaller than that between the projection 15 and the inner peripheral surface of the fore means 2, and therefore, the lead 19 advances from the lead guide 12 to effect writing operation in a manner similar to a conventional mechanical pencil.

On the other hand, in the case where during writing, the end of the lead assumes a frictional state or is broken, the remaining lead 19 is urged against the surface of paper or the like while the outer tube 1 is gripped. Therefore, the force in the direction of backward movement acts on the lead chuck 4 holding the lead 19 and the lead pipe 3, and these members are moved backward against the springing force caused by the flexure of the stopper portion 8*c* together with the chuck fastening ring 7 and the cushion sleeve 8. The range of movement in the direction of backward movement is set, for example, to 0.5 to 1.0 mm or so. Incidentally, since the stopper portion 8*c* is engaged with and supported on the cut 1*a* of the outer tube 1, the maximum amount of backward movement of these members is the dimension G. In the process of backward movement of the lead 19, after the end of the lead 19 has been moved backward to the position of the end of the lead guide 12, the pressing force also acts on the lead guide 12 from the paper surface, and the lead guide 12 is also moved backward together with the slider member 11. At the state where the lead 19 is moved to the rear end of the aforesaid range of movement, the forward end of the lead 19 coincides with the position of the forward end of the lead guide 12.

Subsequently, when pressing of the outer tube 1 toward the paper surface is released, the body 8*b* of the cushion sleeve 8 is moved forward to the front end of the movable range by a biasing reaction resulting from the flexure of the stopper portion 8*c* whereby the chuck fastening ring 7 moves forward together with the lead chuck 4 and the lead 19 held thereby and returns to its original position. However, the lead guide 12 does not move forward due to the great frictional resistance between the projection 15 and the inner peripheral wall of the fore means 2, and thus, the end of the lead 19 is projected from the end of the lead guide 12 by the length corresponding to the amount of backward movement of the lead guide 12. Similar operation may be repeated till the lead guide 12 reaches the rear end of the movable range thereof.

Where the lead 19 needs to be projected after the lead guide 12 has reached the rear end of the movable range thereof, the lead pipe 3 is knocked to effect normal lead-feed operation. By this operation, the lead chuck 4 releases the gripping of the lead 19 and in the process of further advancement, the lead chuck comes into contact with the rear end of the slider member 11 to advance it to the front end of the movable range thereof. At that time, the lead 19 is also moved forward by the same amount together with the slider member 11, and thus, the lead 19 is maintained so that the end thereof is in coincidence with the end of the lead guide 12. Then, when the aforesaid knocking operation is released, the lead chuck 4 is moved backward while leaving the lead and the lead guide 12 at that position and stops at a position where the chuck 4 engages the chuck fastening ring 7. If the knocking operation is again carried out under this state, the lead 19 may be moved forward by a predetermined length by the aforementioned operation.

Figure 8:
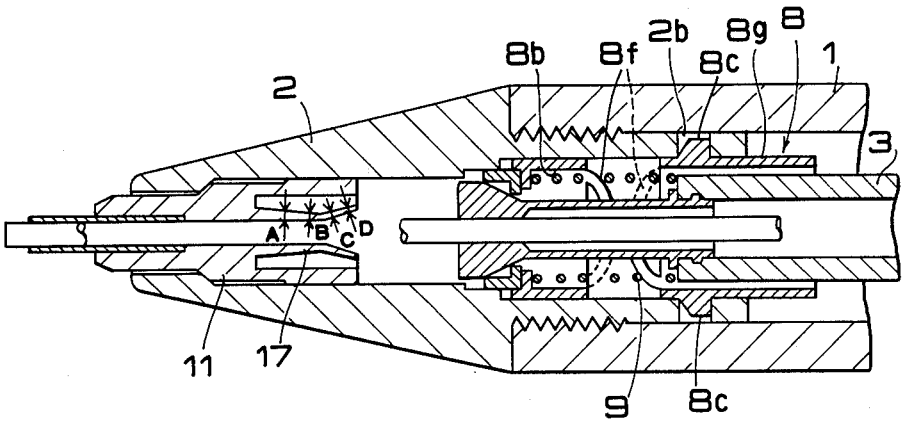
FIG. 8 is a longitudinal sectional view of another embodiment.
Figure 9:
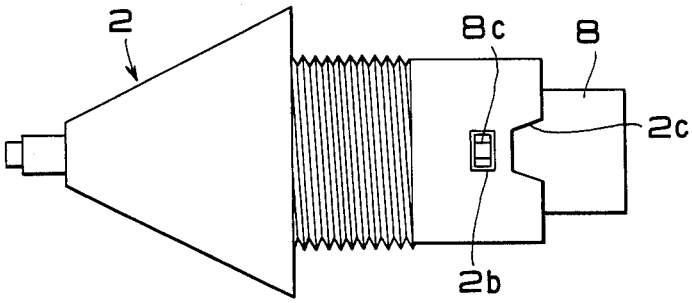
FIG. 9 is a plan view, partly broken away, of the embodiment of FIG. 8.
Figure 10A:
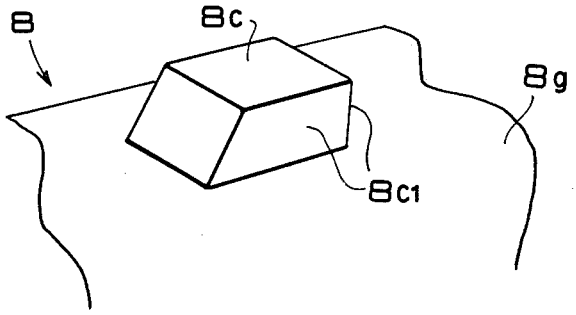
FIG. 10(*a*) is a perspective view of a stopper portion.
Figure 10B:
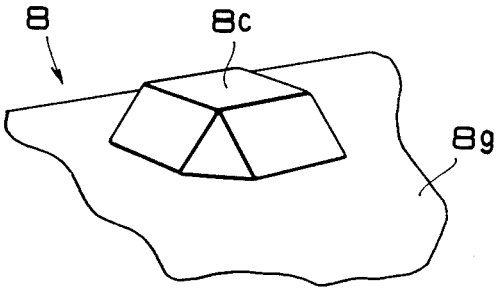

FIGS. 8 to 10 show a further embodiment of the cushion sleeve 8. In this embodiment, the cushion sleeve 8 may be mounted within the fore means 2 without an exclusive-use jig in assembly, and when a broken lead is blocked within the fore means 2, the cushion sleeve 8 may be easily removed from the fore means 2 to remove the broken lead.

The cushion sleeve 8 formed of a material similar to that of the previously-described embodiment comprises, as shown in FIGS. 8 and 9, a body 8*b* whose front end comes into abutment with the rear end of the chuck fastening ring 7 to control the movement of the ring 7 in the direction of backward movement, a cushion portion 8*f* integrally connected to the rear end of the body 8*b* and having an axially expansible resilient biasing property, and a coaxial operating tubular portion 8*g* integrally connected to the rear end of the cushion portion 8f.

The later-described fore means 2 is provided at the rear end with a tapered cut guide portion 2c which is positioned immediately behind the engaging hole 2b as shown in FIG. 9 to guide the stopper portion 8c to the engaging hole 2b when the cushion sleeve 8 is forced into the fore means 2.

There are contemplated two cases in the stopper portion 8c in engagement with the engaging hole 2b of the fore means 2. One case is that as shown in FIG. 10(*a*), where a vertical wall 8c1 is formed so that the stopper portion 8c is positively secured to the engaging hole 2b so as not to be slipped out easily. The other case is that as shown in FIG. 10(*b*), where the stopper portion is formed to be tapered upwardly so as to effect smooth engagement with and disengagement from the engaging hole 2b.

With the above-described arrangement, assemblage of the cushion sleeve 8 may be carried out by holding the operating tubular portion 8g by a hand and forcing it into the fore means 2 from the rear end side thereof without use of an exclusive-use jig.

That is, when the operating tubular portion 8g is held by the hand and forced into the fore means 2 from the rear end side thereof, the stopper portion 8c is guided and moved toward the engaging hole 2b along the cut guide portion 2c of the fore means 2 and the stopper portion 8c engages the holes 2b. With this, the cushion sleeve 8 is set to the fore means 2 in a locked state (in the case of FIG. 10(*a*) or in a disengageable fashion (in the case of FIG. 10(*b*).

Figure 11:
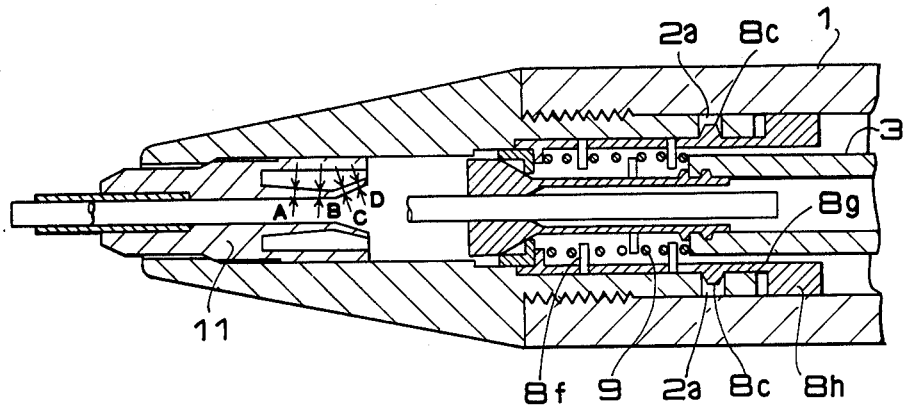
FIG. 11 is a longitudinal sectional view of another embodiment.
Figure 12:
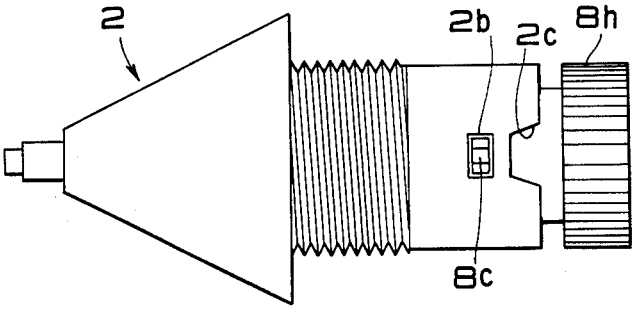
FIG. 12 is a plan view, partly broken away, of the embodiment of FIG. 11.

FIGS. 11 and 12 also show another embodiment of a cushion sleeve 8 which can obtain the similar effect. The cushion sleeve 8 in this embodiment is provided with an axial and annular operating member 8h for assembling operation and rotating operation projected in a direction of the outside diameter at the rear of the fore means 2 and at the rear end of the operating tubular portion 8g.

Accordingly, in this embodiment, the operating member can be held by hand more positively and simply and the assemblage of the cushion sleeve 8 may be carried out by pushing it into the fore means 2 from the rear end thereof without an exclusive-use jig.

As described above, in the mechanical pencil according to the present invention, a lead can be fed out by normal knocking, and when the lead guide 12 is at a position that may be moved backward, the end of the lead 19 is merely pressed against the surface of paper or the like without knocking operation to project the lead 19 by a predetermined length. If a slider member in the form of a single plastic molded article is used in place of a tubular member or a frictional member such as rubber as in prior art, the lead may be fed or projected by simple construction and assembling operation. The slider member 11 may be obtained in volume and at low cost and can be shortened, and therefore, the full length of the mechanical pencil is advantageously reduced. Thus, the lead-feed by knocking operation need not be made during the time the lead 19 is consumed by a portion of movable range of the lead guide 12 and accordingly, continuous writing can be accomplished without changing the gripping. Moreover, if excessive pressure acts on the lead 19 during writing, the lead 19 is resiliently moved back by the springing action of the stopper portion 8c, and therefore, the breakage of the lead 19 may be effectively prevented.

What is claimed is:

1. A mechanical pencil comprising an outer member including an outer tube and a fore means provided on said outer tube, a lead pipe axially movably encased in said outer tube, a lead chuck connected to said lead pipe, a chuck fastening ring for gripping the end of said lead chuck, a cushion sleeve having a stopper portion, said stopper portion being in abutment with said chuck fastening ring, and in engagement with an engaging hole in said outer member, a resilient member disposed between said cushion sleeve and said lead pipe, and a slider member inserted in said fore means and axially movable in a predetermined range with respect to said fore means, said slider member having an inner peripheral surface supporting a lead with a first predetermined frictional resistance, said slider member having an outer peripheral surface disposed in sliding contact with an inner peripheral surface of said fore means with a second frictional resistance greater than the first frictional resistance.

2. The mechanical pencil according to claim 1, wherein said slider member comprises a resilient contact member for supporting the lead with said first predetermined frictional resistance, and said slider member further comprises a second member provided at the outside diameter of said resilient contact member and being placed in sliding contact with said inner peripheral surface of said fore means with said second frictional resistance greater than said first frictional resistance, said resilient contact member and said second member being integrally formed of a plastic material, said slider member further including a lead guide within which the lead is slidably received.

3. The mechanical pencil according to claim 1 or 2, wherein said cushion sleeve is formed at the rear end thereof with an operating tubular portion projected rearwardly of said fore means.

4. A lead feeding slider for a mechanical pencil comprising an axially movable slider means inserted into a fore means of said mechanical pencil, said slider means integrally provided with a resilient sliding contact member holding a lead with a first predetermined frictional resistance and a sliding member placed in sliding contact with the inner peripheral surface of the fore means in the outer peripheral surface thereof with a frictional resistance greater than the first frictional resistance.

* * * * *

US004714365C1

(12) EX PARTE REEXAMINATION CERTIFICATE (7178th)

United States Patent
Kageyama et al.

(10) Number: US 4,714,365 C1
(45) Certificate Issued: Nov. 24, 2009

(54) MECHANICAL PENCIL

(75) Inventors: Hidehei Kageyama, Saitama (JP); Yukimasa Kuwabara, Saitama (JP)

(73) Assignee: Kabushikikaisha Kotobuki, Kito-ku, Kyoto-shi, Kyoto (JP)

Reexamination Request:
No. 90/007,294, Nov. 15, 2004
No. 90/007,620, Jul. 1, 2005

Reexamination Certificate for:

| | |
|---|---|
| Patent No.: | **4,714,365** |
| Issued: | **Dec. 22, 1987** |
| Appl. No.: | **06/849,506** |
| Filed: | **Mar. 14, 1986** |

(22) PCT Filed: Jan. 25, 1986

(86) PCT No.: PCT/JP86/00032

§ 371 (c)(1),
(2), (4) Date: Mar. 14, 1986

(87) PCT Pub. No.: WO86/04300

PCT Pub. Date: Jul. 31, 1986

(30) Foreign Application Priority Data

| | | |
|---|---|---|
| Jan. 26, 1985 | (JP) | 60-9595 |
| Jan. 26, 1985 | (JP) | 60-9596 |
| Oct. 22, 1985 | (JP) | 60-161400 |
| Dec. 28, 1985 | (JP) | 60-203143 |

(51) Int. Cl.
*B43K 21/06* (2006.01)

(52) U.S. Cl. ..... 401/65; 401/67; 401/94

(58) Field of Classification Search ..... 401/65, 401/67, 94
See application file for complete search history.

(56) References Cited

U.S. PATENT DOCUMENTS 4,171,170 A 10/1979 Kageyama et al. ..... 401/65

FOREIGN PATENT DOCUMENTS

| | | |
|---|---|---|
| EP | 0 093 815 A1 | 9/1982 |
| EP | 00938815 | 11/1983 |
| GB | 2 080 206 A | 2/1982 |
| GB | 2080206 | 2/1982 |

*Primary Examiner*—Matthew C. Graham

(57) ABSTRACT

A mechanical pencil wherein a slider 11 in contact with a lead and an outer tube 1 with different frictional resistances other than a lead delivery mechanism for effecting lead-feed by general knocking operation are provided within the outer tube 1 or a fore means 2, whereby the end of a consumed lead 19 is pressed against or released from a surface of paper or the like to thereby project the lead 19 from a lead guide 12 by an amount corresponding to backward movement of the slider 11. The lead-feeding may be easily accomplished merely by pressing operation without changing the grip of the outer tube 1.

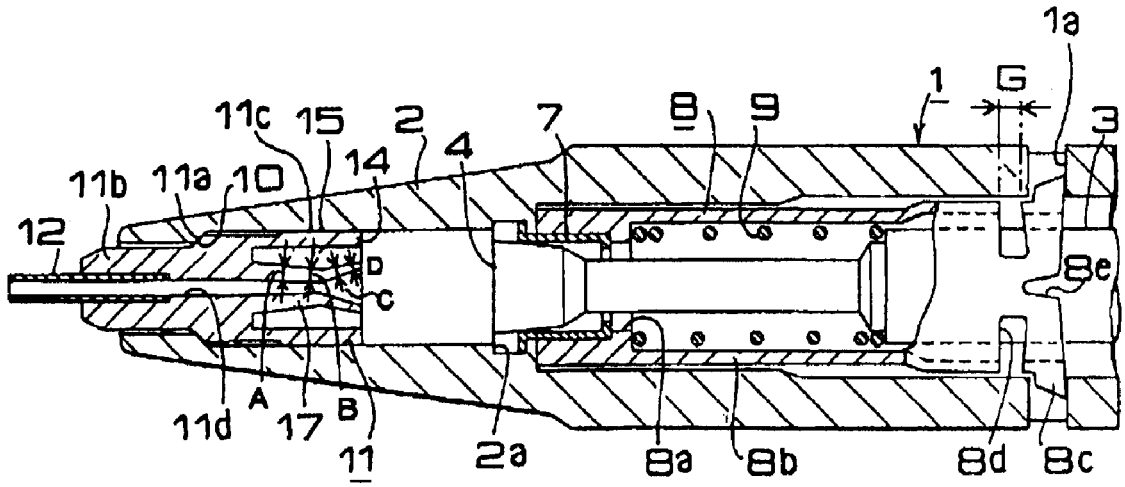

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–4 are cancelled.

* * * * *